United States Patent [19]

McCord

[11] 4,224,110

[45] Sep. 23, 1980

[54] CLEANING DEVICE

[76] Inventor: James W. McCord, 9101 Nottingham Pkwy., Louisville, Ky. 40222

[21] Appl. No.: 857,116

[22] Filed: Dec. 5, 1977

[51] Int. Cl.[2] ..... B08B 7/04

[52] U.S. Cl. ..... 202/169; 134/12; 134/105; 134/108; 134/109; 134/184; 203/39; 203/DIG. 16; 220/22

[58] Field of Search ..... 202/170, 168, 169, 170 D, 202/175, 176; 203/DIG. 16, 43, 39; 134/105, 108, 109, 110, 184, 10, 11, 12; 210/521, 522, 83; 220/22

[56] References Cited

U.S. PATENT DOCUMENTS

| | | | |
|---|---|---|---|
| 1,771,698 | 7/1930 | Wolff | 202/170 |
| 2,625,270 | 1/1953 | DeArmas | 220/22 |
| 2,771,086 | 11/1956 | Kearney | 202/170 |
| 2,837,723 | 3/1958 | Clark | 134/109 |
| 2,845,936 | 8/1958 | Boynton et al. | 134/109 |
| 3,011,500 | 12/1961 | Kand | 202/170 D |
| 3,454,428 | 7/1969 | Hittel et al. | 134/109 |
| 3,688,781 | 9/1972 | Talley | 134/110 |
| 3,707,404 | 12/1972 | Carlson et al. | 134/109 |
| 4,014,751 | 3/1977 | McCord | 202/170 |
| 4,048,069 | 9/1977 | Curillier et al. | 210/522 |

*Primary Examiner*—Wilbur L. Bascomb, Jr.
*Attorney, Agent, or Firm*—Charles G. Lamb

[57] ABSTRACT

A cleaning device including a housing having an open top and a closed bottom with a chamber mounted therein, the chamber having an open top and an open bottom. The housing is disposed to receive a liquid solution therein, the liquid solution containing at least two immiscible components of different densities, the chamber portion of the housing containing only one of the components therein.

11 Claims, 4 Drawing Figures

CLEANING DEVICE

BACKGROUND OF THE INVENTION (1) Field of the Invention

This invention relates to cleaning devices and more particularly relates to a cleaning device utilizing a volatile liquid.

(2) Description of the Prior Art

In the present state of the art, cleaning devices are used for removal of oil, grease, dirt, and the like from metallic tools, plastic parts, and the like with hot, boiling solvents. The cleaning devices are generally provided with chambers containing the boiling solvents wherein the articles to be cleaned are immersed therein. In most cases the solvents utilized have a relatively low vapor pressure at normal work room temperatures (65° F. to 95° F.) and do not vaporize substantially at these temperatures. However, in order to obtain maximum dissolution of the materials to be removed from the objects to be cleaned, heat is applied to these solvents and high vaporization as well as efficiency of cleaning increases. In most of these devices, at selected distances above the liquid level, cooling is applied to the cleaner housing to condense the solvent vapors thereby preventing the vapor from escaping into the work area.

In the last few years with the emphasize being on conservation of energy, attempts have been made to utilize cleaning solvents having relative high vaporizing and low boiling points in order to cut down in the use of energy necessary for vaporizing and condensing the liquid solvent. However, with the high vapor pressures at normal work room temperatures, means for preventing the vapors from going into the work room have presented a problem.

SUMMARY OF THE INVENTION

It has now been found that a cleaning device for removing oil, grease and the like from metallic tools, plastic parts, films, and the like can be accomplished with very little energy expended. Furthermore, it has now been found that a degreasing device using high vapor pressure solvents at normal work room temperatures can be utilized with a minimum amount of vapor escaping into the work room.

Various other features of the present invention will become obvious to those skilled in the art upon reading the disclosure set forth hereinafter.

More particularly, in one preferred embodiment, the present invention provides a cleaning device comprising: a housing having an open top and a closed bottom for receiving a liquid solution containing at least two components therein, a first component being a liquid with a density greater than a second component and immisible therewith; and, a chamber with an open top and an open bottom mounted within the housing, sides of the chamber terminating at their lower extremity below the liquid level of the first component.

It is to be understood that the description of the examples of the present invention given hereinafter are not by way of limitation and various modifications within the scope of the present invention will occur to those skilled in the art upon reading the disclosure set forth hereinafter.

DESCRIPTION OF THE PREFERRED EMBODIMENT

Figure 1:
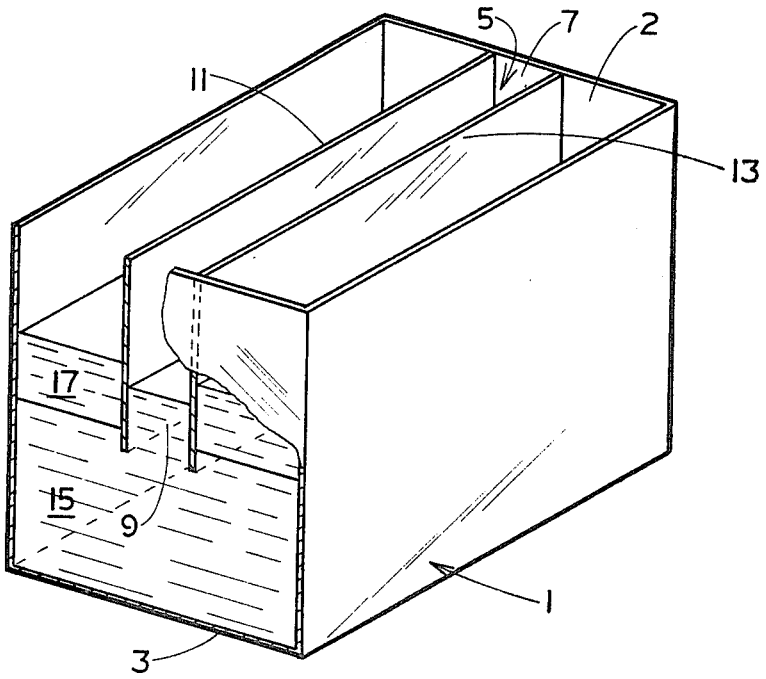
FIG. 1 is a perspective view, partially cut-away, of a preferred embodiment of a cleaning device of the present invention.

In FIG. 1, a container 1 having an open top 2 and a closed bottom 3 includes a trough 5 defining a chamber therein. Trough 5 has an open top 7 and an open bottom 9, through 5 having two vertically extending parallel sides 11 and 13 extending from end to end of container 1 and attached thereto.

Disposed within the container 1 is a liquid divided into two layers, the first or bottom layer 15 being an organic solvent immiscible in and heavier than water, the second or top layer 17 being water. However, only the first layer 15 is contained within the trough 5, the lower extremities of sides 11 and 13 extending below the upper surface of the first layer 15.

In the operation of the cleaning apparatus shown in FIG. 1, a solvent solution 15 or first component of a liquid solution is poured into housing 1. A second component, usually water or another liquid lighter than the solvent in density and immiscible therewith is then poured into the container in the space defined by the outer walls of the container 1 and space parallel sides 11 and 13 so that only the first component or solvent extends upwardly between the parallel sides 11 and 13 thereby defining a chamber in which objects may be cleaned. The objects to be cleaned are then immersed into the solvent in the chamber defined between the parallel plates 11 and 13. Generally, in the cleaning of objects in the device of FIG. 1, the objects to be cleaned are placed within a basket or holder (not shown) and the basket or holder is then dipped into the solvent as described hereinbefore.

Figure 2:
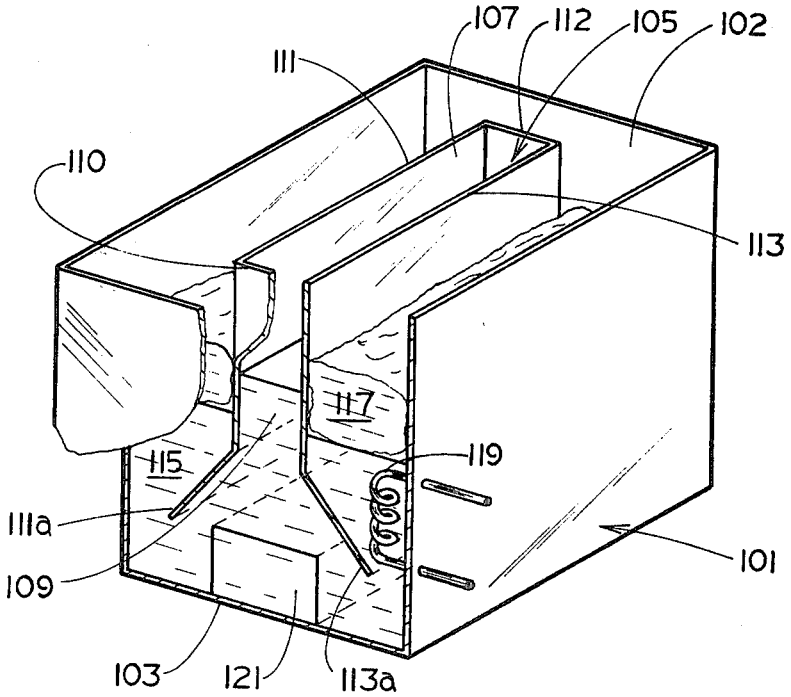
FIG. 2 is a perspective view, partially cut-away, of another preferred embodiment of a cleaning device of the present invention including heat transfer means and ultrasonic vibrating means.

In FIG. 2, the device described in FIG. 1 is shown except that heat transfer means are provided to heat up the solvent (first component) and an ultrasonic vibrator is disposed therein to provide ultrasonic vibrations which initiates cavitation in the heated solvent to remove hard to clean parts from the objects immersed therein.

In FIG. 2, a container 101 having an open top 102 and a closed bottom 103 includes a trough 105 therein. Trough 105 has an open top 107 and an open bottom 109 with all four sides 110, 111, 112 and 113 being enclosed, the trough 105 being attached to side walls of the container 101 by any well known means. Trough 105 is further provided with angularly outwardly extending side portions 111*a* and 113*a* at the lower extremities thereof. Disposed within the container 101 is a liquid divided into two layers, the first or bottom layer 115 having a first component therein, exemplified as an organic solvent immiscible with and heavier than water, the second component or layer 117. The water, as discussed previously, is on top of the first layer thereby preventing evaporation of the highly volatilized solvent. Furthermore, only the first layer 115 is contained within the trough 105, the lower extremities of the outwardly extending sides 111 and 113 extending below the upper surface of the first layer.

The container 101 is also provided with a heating coil 119, the heating coil 119 being connected to a heating source, which may be either electric or any other well known means. Attached to the bottom wall 103 of the container 101 is an ultrasonic transducer 121, ultrasonic transducer 121 being activated in response to an ultrasonic generator (not shown) which is well known in the art. The ultrasonic transducer 121 provides ultrasonic vibrations which initiates cavitation in the solvent to remove hard to clean parts from the objects to be cleaned.

Figure 3:
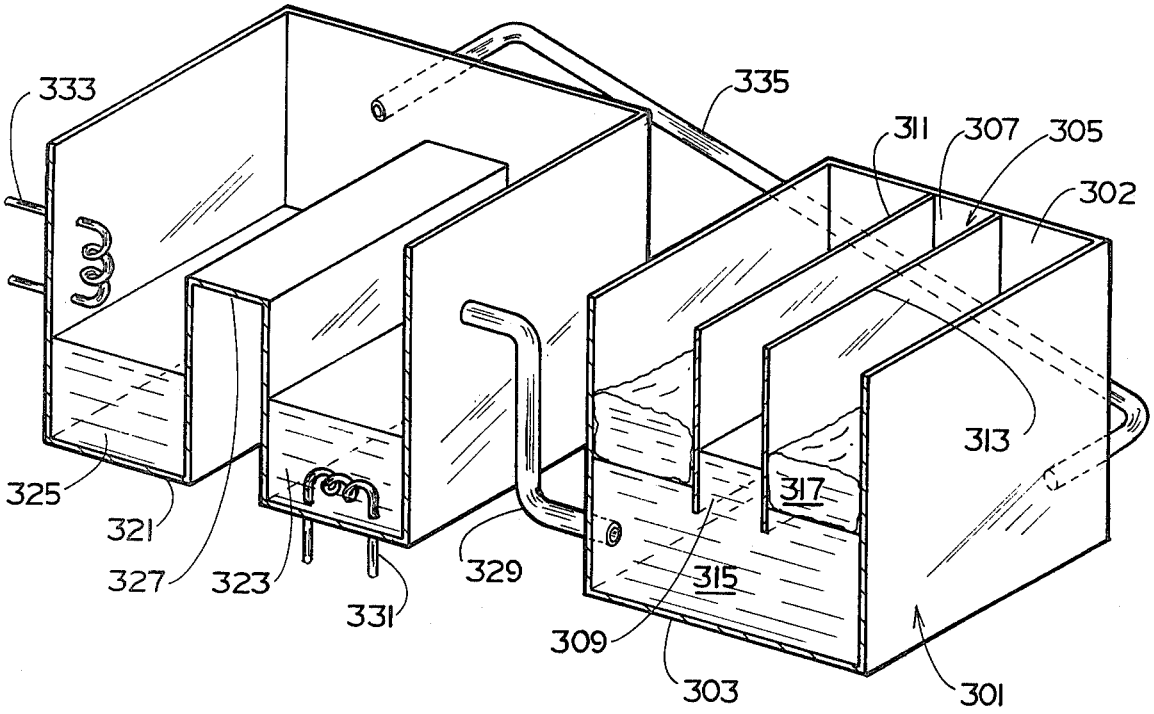
FIG. 3 is a perspective view, partially cut-away, of even another preferred embodiment of a cleaning device of the present invention including solvent cleaning means; and, FIG. 4 is an elevational view of another preferred embodiment of a cleaning device of the present invention including filtration means.

In FIG. 3, a cleaning device of the present invention is shown and includes a device for cleaning the solvent utilized in a chamber to be described hereinafter. In FIG. 3, a first container 301 having an open top 302 and a closed bottom 303 is provided with a trough 305 therein. Trough 305 has an open top 307 and an open bottom 309 and is provided with two vertically extending parallel sides 311 and 313 extending from end to end of container 301 and attached thereto.

Disposed within the container 301 is a liquid solution divided into two layers, the first or bottom layer 315 being an organic solvent immisible with and heavier than water, the second or top layer 317. However, only the first layer 315 is contained within the trough 305, the lower extremities of sides 311 and 313 extending below the upper surface of the first layer 315.

In FIG. 3 a purification chamber 321 is provided, purification chamber 321 being divided into two compartments 323 and 325 with a weir 327 of a preselected height being disposed therebetween to separate the compartments 323 and 325. Disposed between the container 301 and 321 is a conduit 329, conduit 329 having its lower end in communication with the first layer 315 in container 301 and its opposed end in fluid communication with the chamber 323. Heating coil 331 is disposed in the bottom of the chamber 323 for vaporizing the dirty solvent contained therein, the dirty solvent contained therein being thermosiphoned from the container 301 through the conduit 329 and into the chamber 323.

A condensing coil 333 is provided in chamber 325 so that when the vaporizing solvent from the chamber 323 reaches a peselected height above the weir 327, the preselected height being determined by the condensing coil 333, the vaporized solvent condenses and is recovered as a liquid in the chamber 325 leaving behind the non-vaporized particulates or dirt in the chamber 323. The cleaned solvent in chamber 325 which is at a temperature less than the temperature within the container 301 is then gravity fed through line 335 into the bottom of the container 301 wherein the condensed solvent is then recovered in container 301 for re-use.

Periodically, the particulates build-up in the container and must be removed. Means for removal of the particulates from the chamber 323 may be by any known means such as periodic cleaning of the unit upon shutdown.

Figure 4:
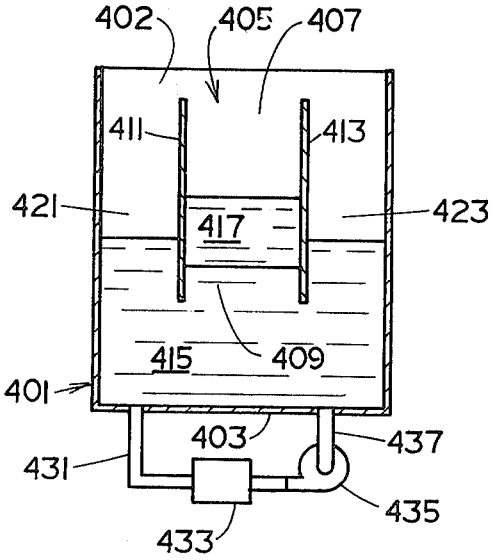

In FIG. 4, another embodiment of the present invention is shown. In FIG. 4, container 401 having an open top 402 and a closed bottom 403 includes a trough 405 therein. Trough 405 has an open top 407 and an open bottom 409, trough 405 having two vertically extending parallel sides 411 and 413 extending from end to end of container 401 and attached thereto. Disposed within the container 401 is a liquid divided into two layers, the first or bottom layer 415 being an organic solvent immisible with and heavier than water, the second or top layer 417. However, the second layer 417 is contained within the trough 405 to prevent the evaporation of the bottom layer 415, the lower extremities of sides 411 extending 413 below the bottom surface of the second layer 417. In this type of arrangement, a cleaning chamber is defined by the walls of the housing and the sides of the trough. In this cleaning chamber films and strips or other material which are to be cleaned in a continuous operation may be fed into one side of the chamber, identifiable by numeral 421, and removed from the opposite side of the chamber, identifiable by numeral 423.

A filtration system is also provided in the embodiment shown in FIG. 4 to remove the particulates from the solvent which have been removed from the objects cleaned as they pass through the solvent 415. The filtration system includes a discharge line 431 in communication with an opening in the bottom of the container wall 403 to feed a filter 433, filter 433 being any known in the prior art. A pump 435 and a discharge conduit 437 which is in flow communication with another opening in the bottom of the container 403 are also provided for circulating the solvent through the filtration system.

As can be seen from the examples shown and described it will be realized that various changes may be made to the specific embodiment shown without departing from the principles and scope of the present invention. For example, the cleaning device may include pickling operations wherein one of the components is an acid and the other component is a liquid heavier than a pickling acid and immiscible therewith and non-corrosive to a transducer or the like which may be located on the bottom of the housing. Furthermore, the housing and cleaning chamber may take on other shapes than those exemplified and one housing may include a plurality of cleaning chambers therein. Even further, the cleaning device may include a system in which a non-dissolvable material separates the two liquid components.

What is claimed is:

1. A cleaning device consisting essentially of:

a housing having an open top and a closed bottom for receiving a liquid solution containing at least two components therein, the first component being immiscible with and denser than a second component;

a chamber having an open top and an opening in the bottom stationarily mounted within the housing with sides of the chamber terminating at the upper extremity above the second component and the lower extremity below the liquid level of the first component; and, means for cleaning or finishing objects mounted within said housing.

2. The cleaning device of claim 1 wherein said first component is a solvent.

3. The cleaning device of claim 1 wherein only the first component is disposed within the chamber.

4. The cleaning device of claim 1 wherein only the first component is disposed between the chamber and the housing.

5. The cleaning device of claim 1 including heat transfer means mounted therein.

6. The cleaning device of claim 1 including ultrasonic vibrating means mounted therein.

7. The cleaning device of claim 1 including filtration means in fluid communication with said housing.

8. The cleaning device of claim 7 wherein said filtration means includes a re-circulating system in fluid communication with the bottom of said housing, said fluid re-circulating system including filter means and pump means therein.

9. The cleaning device of claim 1 including a purification means for said first component, said purification means including a container with two sub-chambers therein, said sub-chambers being separated by a wall of preselected height, said container being connected to said housing by a conduit means, said conduit means being in flow communication with one of said sub-chambers and the first solvent layer of said housing, said one of said sub-chambers having heat emitting means disposed therein and said other of said sub-chambers having condensing means therein, said condensing means being disposed at a preselected position above said wall of preselected height, said other of said sub-chambers incuding an opening therein in communication with a second conduit, said second conduit being in flow communication with an opening in said housing.

10. The cleaning device of claim 1 wherein said chamber includes at least two sides attached to opposed ends of said housing.

11. The cleaning device of claim 1 wherein said chamber includes two opposed ends attached to and connecting at least two sides of said chamber.

* * * * *